US005462007A

United States Patent [19]

Prescott

[11] Patent Number: 5,462,007

[45] Date of Patent: Oct. 31, 1995

[54] BOOKMARK

[76] Inventor: Leslie K. Prescott, 612 Newton Ave., Uniondale, N.Y. 11553

[21] Appl. No.: 292,385

[22] Filed: Aug. 18, 1994

[51] Int. Cl.[6] ..... B42D 9/00

[52] U.S. Cl. ..... 116/239; 116/234; 281/42

[58] Field of Search ..... 116/234, 235, 116/236, 237, 238, 293; 281/42

[56] References Cited

U.S. PATENT DOCUMENTS

| | | | |
|---|---|---|---|
| 661,328 | 11/1900 | Taylor | 281/42 |
| 1,914,001 | 6/1933 | Warshay | 116/239 X |
| 3,055,680 | 9/1962 | Stoffel | 116/234 X |
| 5,054,816 | 10/1991 | Rosengarten | 281/42 |

FOREIGN PATENT DOCUMENTS

| | | | |
|---|---|---|---|
| 48457 | 5/1934 | Denmark | 281/42 |
| 814294 | 6/1937 | France | 281/42 |
| 507913 | 9/1930 | Germany | 281/42 |
| 476274 | 12/1937 | United Kingdom | 281/42 |

*Primary Examiner*—William A. Cuchlinski, Jr.
*Assistant Examiner*—Willie Morris Worth

[57] ABSTRACT

A bookmark for recording a reader's position within a book. The inventive device includes a mounting band securable about the cover of the book, with a positioning band coupled to the mounting band. A marker member is coupled to the positioning band and can be placed over the corner of the desired page to record the reader's position within the book.

4 Claims, 4 Drawing Sheets

BOOKMARK

BACKGROUND OF THE INVENTION

1. Field of the Invention

The present invention relates to position marking devices and more particularly pertains to a bookmark for recording a reader's position within a book.

2. Description of the Prior Art

The use of position marking devices is known in the prior art. More specifically, position marking devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art position marking devices include U.S. Pat. Nos. 4,778,201; 5,237,956; 4,285,532; 4,395,057; 4,437,685.

While these devices fulfill their respective, particular objectives and requirements, the aforementioned patents do not disclose a bookmark for recording a reader's position within a book which includes a mounting band securable about the cover of the book, with a positioning band coupled to the mounting band, and a marker member coupled to the positioning band which may be placed over the corner of the desired page to record the reader's position within the book.

In these respects, the bookmark according to the present invention substantially departs from the conventional concepts and designs of the prior art, and in so doing provides an apparatus primarily developed for the purpose of recording a reader's position within a book.

SUMMARY OF THE INVENTION

In view of the foregoing disadvantages inherent in the known types of position marking devices now present in the prior art, the present invention provides a new bookmark construction wherein the same can be utilized for recording a reader's position within a book. As such, the general purpose of the present invention, which will be described subsequently in greater detail, is to provide a new bookmark apparatus and method which has many of the advantages of the position marking devices mentioned heretofore and many novel features that result in a bookmark which is not anticipated, rendered obvious, suggested, or even implied by any of the prior art position marking devices, either alone or in any combination thereof.

To attain this, the present invention generally comprises a bookmark for recording a reader's position within a book. The inventive device includes a mounting band securable about the cover of the book, with a positioning band coupled to the mounting band. A marker member is coupled to the positioning band and can be placed over the corner of the desired page to record the reader's position within the book.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bookmark apparatus and method which has many of the advantages of the position marking devices mentioned heretofore and many novel features that result in a bookmark which is not anticipated, rendered obvious, suggested, or even implied by any of the prior art position marking devices, either alone or in any combination thereof.

It is another object of the present invention to provide a new bookmark which may be easily and efficiently manufactured and marketed.

It is a further object of the present invention to provide a new bookmark which is of a durable and reliable construction.

An even further object of the present invention is to provide a new bookmark which is susceptible of a low cost of manufacture with regard to both materials and labor, and which accordingly is then susceptible of low prices of sale to the consuming public, thereby making such bookmarks economically available to the buying public.

Still yet another object of the present invention is to provide a new bookmark which provides in the apparatuses and methods of the prior art some of the advantages thereof, while simultaneously overcoming some of the disadvantages normally associated therewith.

Still another object of the present invention is to provide a new bookmark for recording a reader's position within a book.

Yet another object of the present invention is to provide a new bookmark which includes a mounting band securable about the cover of the book, with a positioning band coupled to the mounting band, and a marker member coupled to the positioning band which may be placed over the corner of the desired page to record the reader's position within the book.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
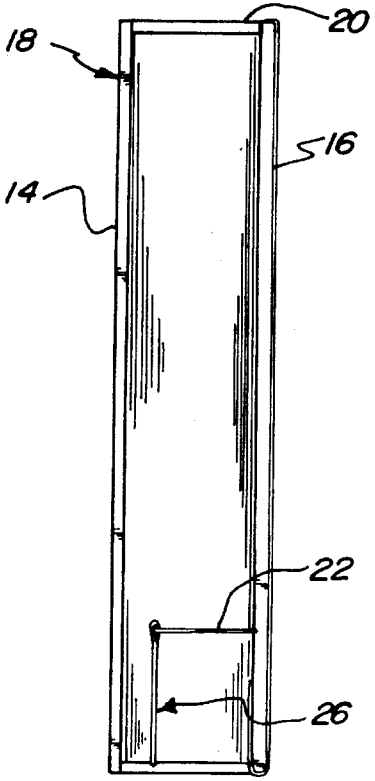
FIG. 2 is a side elevation view of the bookmark attached to a book.

With reference now to the drawings, and in particular to FIGS. 1–8 thereof, a new bookmark embodying the principles and concepts of the present invention and generally designated by the reference numeral 10 will be described.

Figure 1:
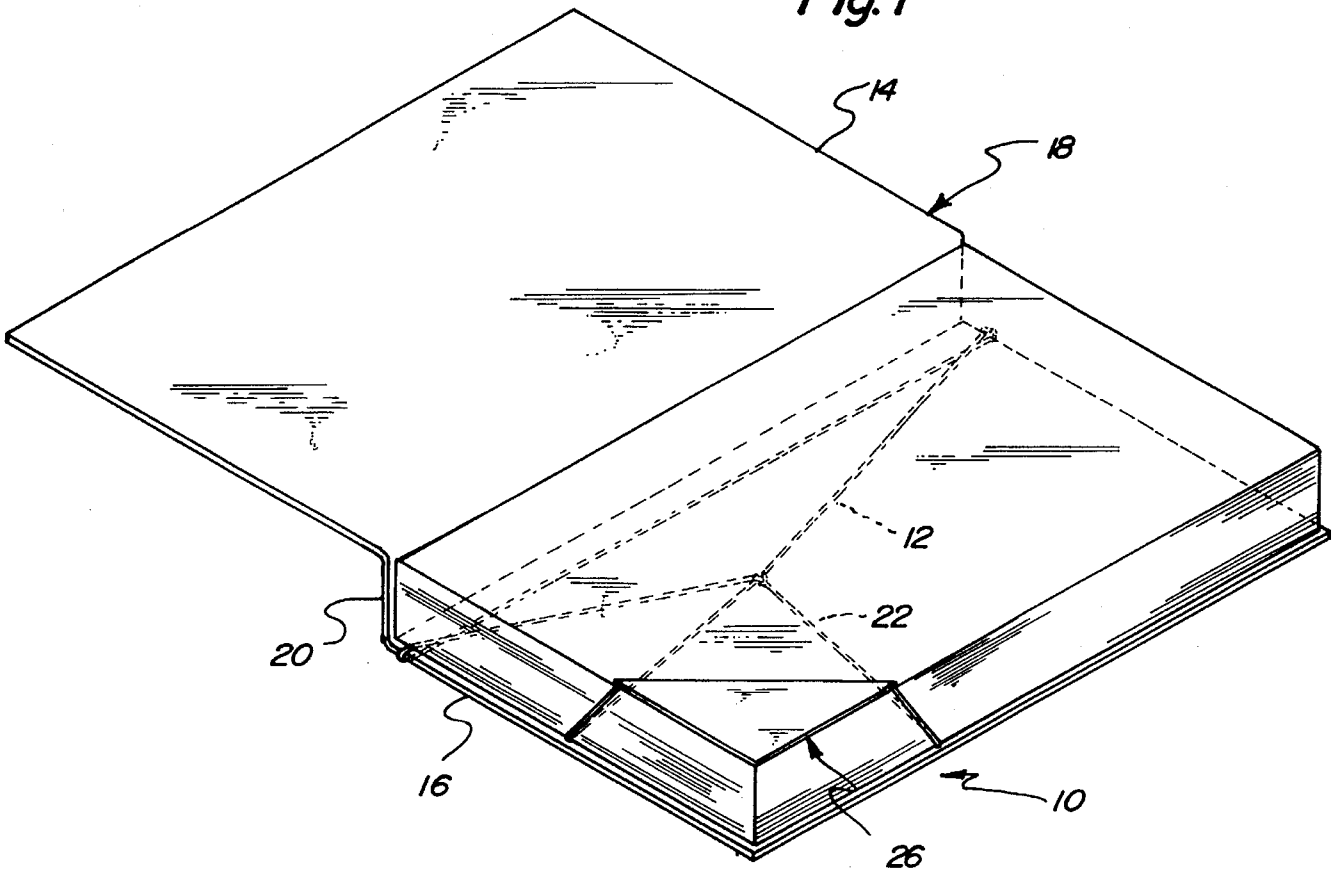
FIG. 1 is an isometric illustration of a bookmark according to the present invention in use.
Figure 3:
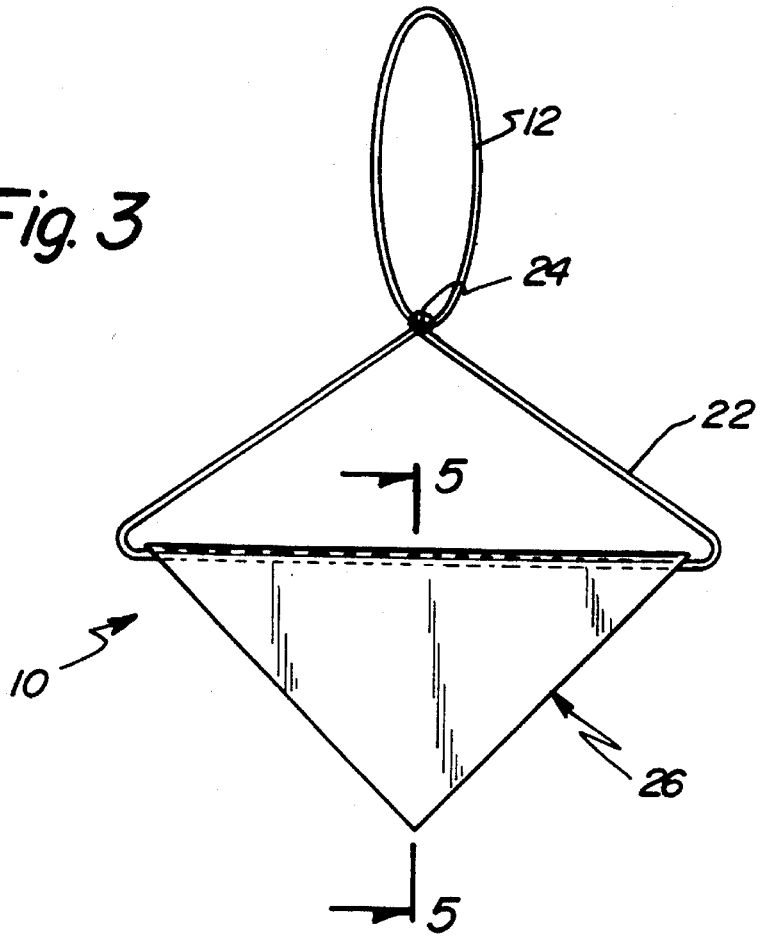
FIG. 3 is a top plan view of the device.

More specifically, it will be noted that the bookmark 10 comprises a mounting band 12 which may be secured about the front cover 14 or the rear cover 16 of a book 18, as illustrated in FIG. 1, for example. Preferably, the mounting band 12 is extended around the rear cover 16 and positioned proximate to the spine 20 of the book 18. The mounting band 12 comprises a circular length material which may be resiliently deformed. Preferably, the mounting band 12 comprises a rubber band which may be stretched and positioned over the rear cover 16, whereby the elastic nature of the rubber band will cause the mounting band 12 to frictionally engage the rear cover. As best illustrated in FIG. 3, a positioning band 22 is coupled to the mounting band 12 by a connecting means 24. The connecting means 24 may comprise a knot formed of intertwined portions of both the mounting band 12 and the positioning band 22, or alternatively, the connecting means 24 may comprise a simple looping of the positioning band 22 through the mounting band 12, where the positioning band 22 is retained to the mounting band 12, yet still permitted to slide relative thereto. Positioning band 22, in a manner similar to that of the mounting band 12, is preferably constructed of a substantially resilient circular length of material such as a further rubber band or the like.

Figure 4:
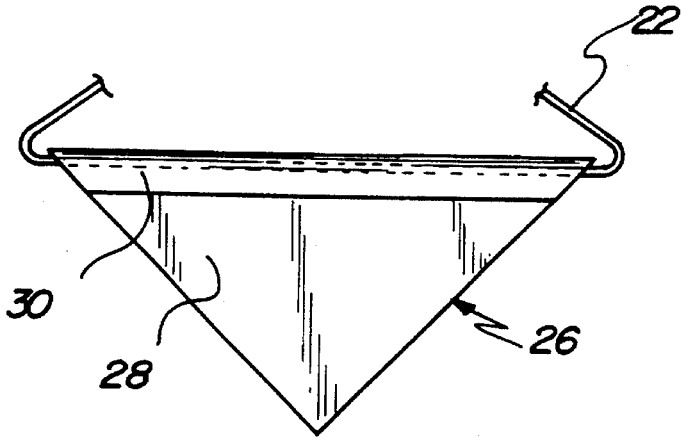
FIG. 4 is a bottom plan view of the bookmark.
Figure 5:
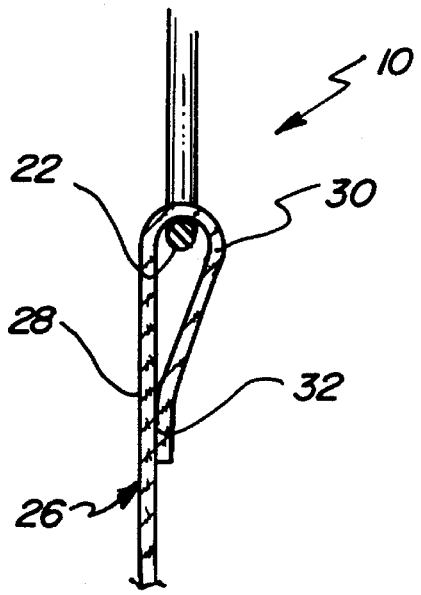
FIG. 5 is a cross sectional view taken along the line 5—5 of FIG. 3.
Figure 6:
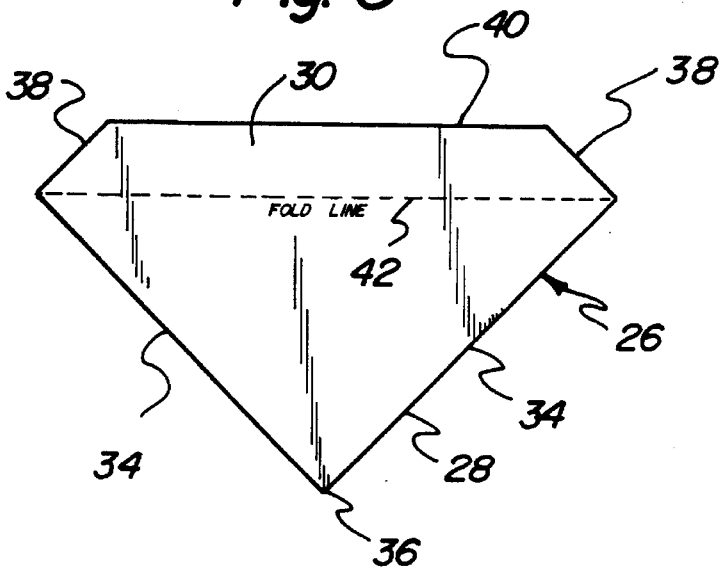
FIG. 6 is a plan view of a blank forming the marker member.

Regardless of the connecting means 24 utilized to join the positioning band 22 to the mounting band 12, the positioning band extends from the mounting band and joins with a marker member 26 having a preferably triangular shape. The marker member 26 is operable to be positioned on top of a page to be marked, as illustrated in FIG. 1, whereby the marked page and the pages remaining to be read are removably joined together for storage. Preferably, the marker 26 is positioned over a corner of the marked page as illustrated. Referring now to FIGS. 4 through 6, it can be shown that the marker 26 comprises a main body 28 having a retaining flap 30 which extends about the positioning band 22. The retaining flap 30 is secured about the positioning band 22 to the main body 28 by a securing means 32 which may comprise adhesive, mechanical fasteners such as staples or the like. Should be marker 26 be comprised of a plastic material, the securing means 32 may comprise a heat sealed edge. Preferably, the positioning band 22 is free to move through the cavity defined between the retaining flap 30 and the main body 28 of the marker 26.

FIG. 6 illustrates a blank which may be formed into the marker 26 as described above. The blank for the marker 26 comprises the main body 28, with the main body having a pair of main body edges 34 preferably oriented at a right angle to define a corner point 36 positionable in alignment with a corner of the page to be marked. The main body edges 34 intersect orthogonally oriented lateral edges 38 which cooperate with a top edge 40 to define the retaining flap 30. A weakened fold line 42 extends from a first intersection of a first lateral edge and a first main body edge to a second intersection of a second lateral edge and a second main body edge such that the retaining flap 30 may be folded over the positioning band 22, as illustrated in FIG. 5.

Figure 7:
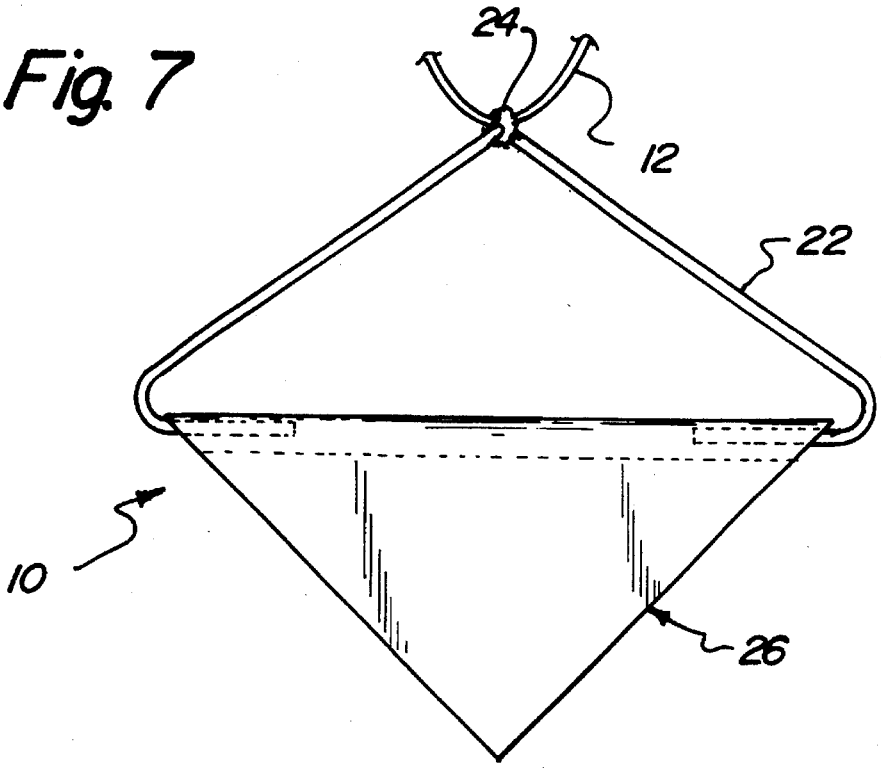
FIG. 7 is a further top plan view illustrating an alternative connection between the positioning band and the marker member.
Figure 8:
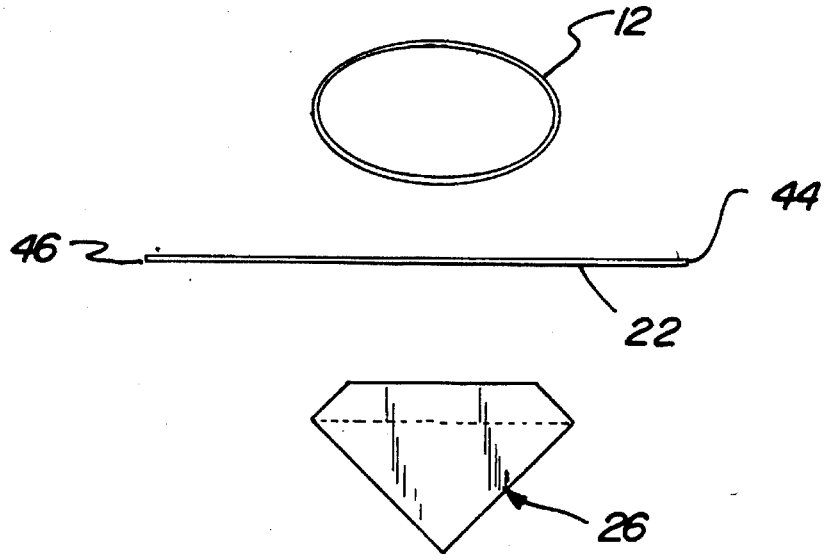
FIG. 8 is an exploded view of the components forming the bookmark.

Turning now to FIG. 7 and 8, it can be shown that the positioning band 22 may alternatively comprise a length of elastic material having first and second ends 44, 46 which permits ease of assembly of the device 10. To this end, the positioning band 22 may simply be extended through the mounting band 12, whereby the first and second ends 44, 46 of the positioning band can then be secured between the retaining flap 30 and the main body 28 of the marker 26 by adhesive or mechanical fastening means. Preferably, the first and second ends 44, 46 of the positioning band 22 are secured within the cavity defined between the retaining flap 30 and the main body 28 of the marker 26 by an adhesive, with the same adhesive being utilized as the securing means 32 to secure the retaining flap 30 to the main body 28 of the marker 26. When assembled in this manner, it is desirable that the connecting means 24 comprise the simple looping of the positioning band 22 through the mounting band 12 such that the positioning band may then freely move relative to the mounting band 12 during installation and use of the device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bookmark comprising:

a mounting band which may be secured about a cover of a book, said mounting band comprising a circular length material which can be resiliently deformed;

a positioning band, said positioning band comprising a circular length material which can be resiliently deformed;

connecting means for coupling said positioning band to said mounting band, said connecting means comprising a knot formed of intertwined portions of both said mounting band and said positioning band;

a marker member mounted to said positioning band, said marker member being operable to be positioned on top of a page of said book to be marked whereby said marked page and pages between said marked page and a portion of said cover are removably joined together for storage;

said marker member comprising a main body having a retaining flap which extends about the positioning band, said retaining flap being secured about said positioning band to said main body by a securing means, said positioning band being free to move through a cavity defined between said retaining flap and said main body of said marker member; and said marker member being formed from a blank, said blank comprising said main body with said main body having a pair of main body edges oriented at a right angle to define a corner point positionable in alignment with a corner of said page to be marked, said main body edges intersecting orthogonally oriented lateral edges cooperating with a top edge of the marker blank to define said retaining flap with a weakened fold line extending from a first intersection of a first of said lateral edges and a first of said main body edges to a second intersection of a second of said lateral edges and a second of said main body edges such that said retaining flap can be folded over said positioning band.

2. A bookmark comprising:

a mounting band which may be secured about a cover of a book, said mounting band comprising a circular length material which can be resiliently deformed;

a positioning band, said positioning band comprising a circular length material which can be resiliently deformed;

connecting means for coupling said positioning band to said mounting band, said connecting means comprising a knot formed of intertwined portions of both said mounting band and said positioning band, said connecting means further comprising a looping of said positioning band through the mounting band whereby said positioning band is slidably retained to said mounting band;

a marker member mounted to said positioning band, said marker member being operable to be positioned on top of a page of said book to be marked whereby said marked page and pages between said marked page and a portion of said cover are removably joined together for storage, said marker member further comprising a main body having a retaining flap which extends about the positioning band, said retaining flap being secured about said positioning band to said main body by a securing means wherein said positioning band is free to move through a cavity defined between said retaining flap and said main body of said marker member; and said marker member being formed from a blank, said blank comprising said main body with said main body having a pair of main body edges oriented at a right angle to define a corner point positionable in alignment with a corner of said page to be marked, said main body edges intersecting orthogonally oriented lateral edges cooperating with a top edge of the marker blank to define said retaining flap with a weakened fold line extending from a first intersection of a first of said lateral edges and a first of said main body edges to a second intersection of a second of said lateral edges and a second of said main body edges such that said retaining flap can be folded over said positioning band.

3. A bookmark comprising:

a mounting band which may be secured about a cover of a book;

a positioning band, said positioning band comprising a length of elastic material having first and second ends wherein said first and second ends of said positioning band are coupled to said marker member;

connecting means for coupling said positioning band to said mounting band, said connecting means comprising a knot formed of intertwined portions of both said mounting band and said positioning band;

a marker member mounted to said positioning band, said marker member being operable to be positioned on top of a page of said book to be marked whereby said marked page and pages between said marked page and a portion of said cover are removably joined together for storage, said marker member further comprising a main body having a retaining flap which extends about said first and second ends of said positioning band, said retaining flap being secured about said first and second ends of said positioning band and to said main body by a securing means; and said marker member being formed from a blank, said blank comprising said main body with said main body having a pair of main body edges oriented at a right angle to define a corner point positionable in alignment with a corner of said page to be marked, said main body edges intersecting orthogonally oriented lateral edges cooperating with a top edge of the marker blank to define said retaining flap with a weakened fold line extending from a first intersection of a first of said lateral edges and a first of said main body edges to a second intersection of a second of said lateral edges and a second of said main body edges such that said retaining flap can be folded over said positioning band.

4. A bookmark comprising:

a mounting band which may be secured about a cover of a book;

a positioning band, said positioning band comprising a length of elastic material having first and second ends wherein said first and second ends of said positioning band are coupled to said marker member;

connecting means for coupling said positioning band to said mounting band, said connecting means comprising a looping of said positioning band through the mounting band whereby said positioning band is slidably retained to said mounting band;

a marker member mounted to said positioning band, said marker member being operable to be positioned on top of a page of said book to be marked whereby said marked page and pages between said marked page and a portion of said cover are removably joined together for storage, said marker member further comprising a main body having a retaining flap which extends about said first and second ends of said positioning band, said retaining flap being secured about said first and second ends of said positioning band and to said main body by a securing means; and said marker member being formed from a blank, said blank comprising said main body with said main body having a pair of main body edges oriented at a right angle to define a corner point positionable in alignment with a corner of said page to be marked, said main body edges intersecting orthogonally oriented lateral edges cooperating with a top edge of the marker blank to define said retaining flap with a weakened fold line extending from a first intersection of a first of said lateral edges and a first of said main body edges to a second intersection of a second of said lateral edges and a second of said main body edges such that said retaining flap can be folded over said positioning band.

* * * * *